US008991406B1

(12) United States Patent
Salter

(10) Patent No.: US 8,991,406 B1
(45) Date of Patent: Mar. 31, 2015

(54) COMBINATION WIG AND CARRYING POUCH

(71) Applicant: Shelah D. Salter, Plano, TX (US)

(72) Inventor: Shelah D. Salter, Plano, TX (US)

( * ) Notice: Subject to any disclaimer, the term of this patent is extended or adjusted under 35 U.S.C. 154(b) by 0 days.

(21) Appl. No.: 14/080,119

(22) Filed: Nov. 14, 2013

(51) Int. Cl.

| | |
|---|---|
| ***A41G 3/00*** | (2006.01) |
| ***A41G 5/00*** | (2006.01) |
| ***A45D 8/40*** | (2006.01) |
| ***A45C 11/02*** | (2006.01) |
| ***B65D 85/18*** | (2006.01) |
| ***A42B 1/00*** | (2006.01) |

(52) U.S. Cl.

CPC ..... *A41G 3/00* (2013.01); *A41G 3/0041* (2013.01); *A45C 11/02* (2013.01); *A41G 3/0016* (2013.01); *A41G 5/0093* (2013.01)

USPC ..... 132/201; 132/53; 132/54; 132/274; 206/8; 2/209.11

(58) Field of Classification Search

CPC . A41G 3/0008; A41G 3/0016; A41G 3/0041; A41G 3/00; A41G 5/0093; A45D 8/40; A45D 8/34; A42B 1/04; A42B 1/22; A42B 1/24; A42B 7/00; A42B 1/006; A42B 1/026; A42B 1/201; A45C 11/02; B65D 85/18

USPC ..... 132/53–56, 200, 201, 212, 273, 274, 132/333, 60, 105; 2/171, 174, 202, 204, 2/207, 209.11, 209.13, 109.14, 209.14; 206/581, 823, 235, 466, 8, 822; 220/9.1, 9.2, 890; 434/94; 223/1, 66, 223/120

See application file for complete search history.

(56) References Cited

U.S. PATENT DOCUMENTS

| | | | | |
|---|---|---|---|---|
| 1,105,986 | A * | 8/1914 | McKenzie | 206/8 |
| 3,145,393 | A | 8/1964 | Mufich | |
| 3,197,787 | A | 8/1965 | Tognan et al. | |
| 3,285,307 | A * | 11/1966 | Dormaier | 383/4 |
| 3,935,871 | A * | 2/1976 | Kern | 132/54 |
| 4,155,370 | A * | 5/1979 | Nemoto | 132/53 |
| 4,610,038 | A * | 9/1986 | Dennard | 2/209.11 |
| 4,683,596 | A | 8/1987 | Cole | |
| 4,804,003 | A * | 2/1989 | Moen | 132/53 |
| 4,819,671 | A * | 4/1989 | Walker | 132/54 |
| 4,937,885 | A * | 7/1990 | Gregg | 2/209.11 |
| 5,137,037 | A * | 8/1992 | Mochizuki | 132/53 |
| 5,204,994 | A * | 4/1993 | Herzberg et al. | 2/171 |
| 5,265,278 | A | 11/1993 | Watanabe | |
| 5,337,763 | A * | 8/1994 | Haber et al. | 132/54 |
| 5,450,629 | A * | 9/1995 | Gilstrap | 2/209.11 |
| 5,472,003 | A * | 12/1995 | Frame et al. | 132/275 |
| 5,477,561 | A | 12/1995 | Adkins | |
| 5,579,540 | A * | 12/1996 | Walker | 2/209.11 |
| 5,822,800 | A * | 10/1998 | Anderson | 2/202 |
| 6,105,584 | A * | 8/2000 | Williams | 132/53 |
| 6,216,278 | B1 | 4/2001 | Nguyen et al. | |
| 6,935,349 | B2 * | 8/2005 | Nicot et al. | 132/53 |
| 7,458,383 | B2 | 12/2008 | Song | |
| 7,735,495 | B2 * | 6/2010 | Lane et al. | 132/53 |

(Continued)

OTHER PUBLICATIONS http://www.youtube.com/watch?v=EjAURNUpxtE, dated Nov. 10, 2009.*

*Primary Examiner* — Vanitha Elgart
(74) *Attorney, Agent, or Firm* — Richard L. Miller

(57) ABSTRACT

A wig for a wearer. The wig includes a cap and primary hair. The cap is worn by the wearer. The primary hair is affixed to the cap, and when the wig is worn by the wearer, the wearer has a pre-styled hairdo.

21 Claims, 9 Drawing Sheets

(56) References Cited

U.S. PATENT DOCUMENTS

| | | | | |
|---|---|---|---|---|
| D627,954 | S | 11/2010 | Williams | |
| 8,042,553 | B2 * | 10/2011 | Paris | 132/201 |
| 8,584,682 | B1 * | 11/2013 | Naylor | 132/54 |
| 2003/0140934 | A1 * | 7/2003 | Sugai et al. | 132/53 |
| 2004/0168696 | A1 | 9/2004 | Cox | |
| 2006/0260627 | A1 * | 11/2006 | Park | 132/54 |
| 2008/0047572 | A1 | 2/2008 | Park | |
| 2008/0134405 | A1 * | 6/2008 | Smith | 2/68 |
| 2008/0178902 | A1 * | 7/2008 | Moeszinger | 132/273 |
| 2009/0106878 | A1 * | 4/2009 | Hiskey | 2/207 |
| 2009/0133710 | A1 * | 5/2009 | Wee | 132/274 |
| 2009/0241973 | A1 * | 10/2009 | Hampton | 132/54 |
| 2009/0241974 | A1 * | 10/2009 | Hampton | 132/54 |
| 2010/0058515 | A1 * | 3/2010 | Castle | 2/207 |
| 2010/0236563 | A1 * | 9/2010 | Kimura et al. | 132/54 |
| 2010/0313902 | A1 * | 12/2010 | Lane | 132/54 |
| 2011/0132942 | A1 | 6/2011 | Choi | |
| 2012/0247495 | A1 * | 10/2012 | Montgomery | 132/54 |
| 2014/0209115 | A1 * | 7/2014 | Eaton | 132/201 |

* cited by examiner

METHOD FOR SELF-STORING THE WIG 20
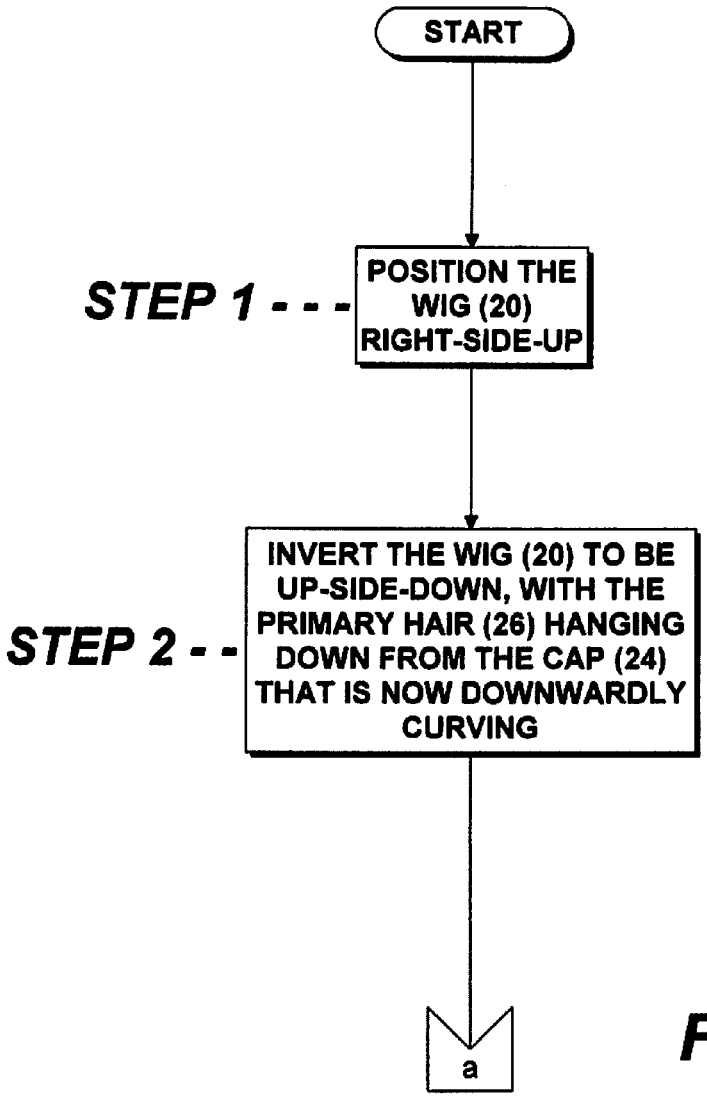
Fig. 11-A

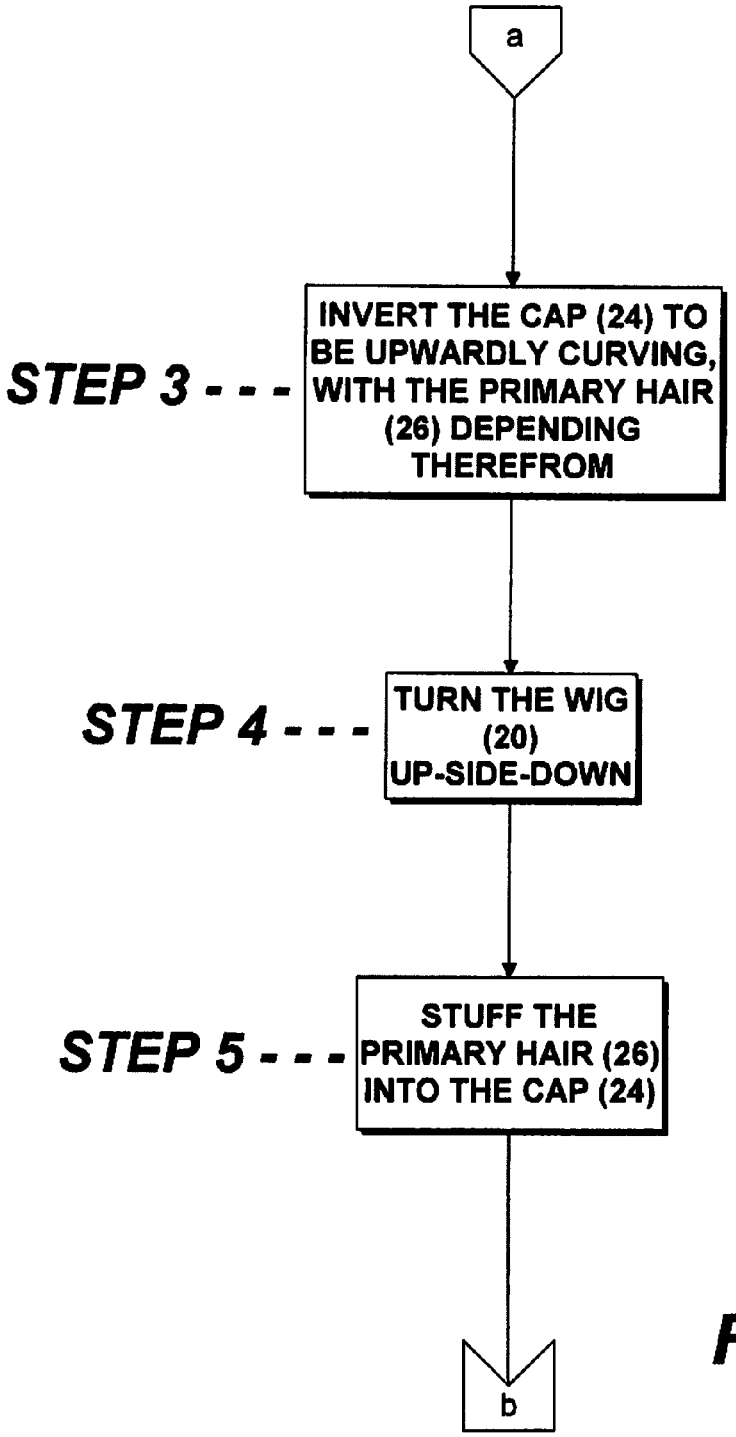
Fig. 11-B

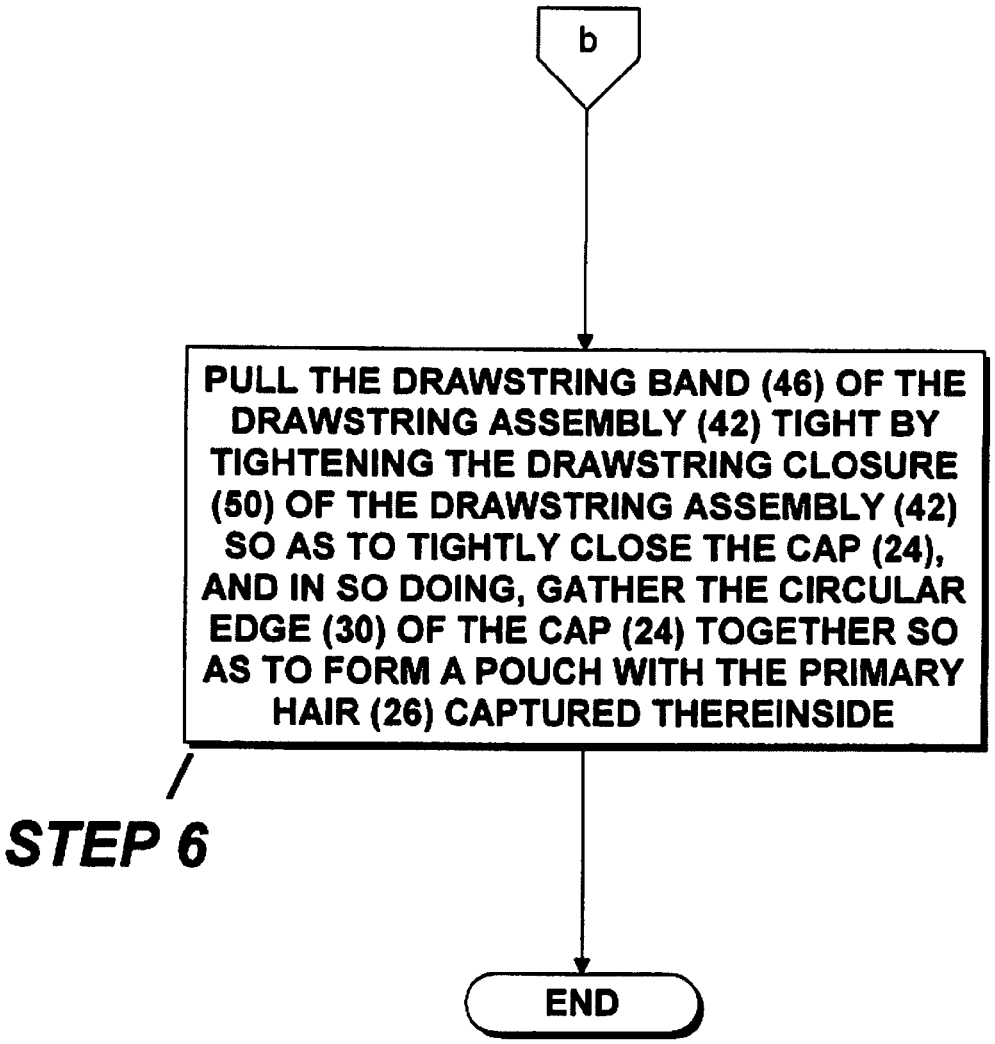
Fig. 11-C

COMBINATION WIG AND CARRYING POUCH

BACKGROUND OF THE INVENTION

1. Field of the Invention

The present invention relates to a wig, and more particularly, a combination wig and carrying pouch.

2. Description of the Prior Art

Most women struggle with what to do with their hair at night, protective styles are very necessary, especially for those with highly textured hair. Head covering passed down from traditional African customs have not changed mush over the years. This leaves women to wear hair bonnets, turbans, and scarfs to protect their hair while they sleep. While some are quite lovely, they pale into significance in comparison to a head full of beautiful hair.

Numerous innovations for head/hair coverings have been provided in the prior art that will be described. Even though these innovations may be suitable for the specific individual purposes to which they address, however, they differ from the present invention.

A FIRST EXAMPLE, U.S. Patent Office Document No. 3,145,393, Published/Issued on Aug. 25, 1964, to Mufich teaches a disposable and protective head covering formed of a blank of highly porous material. The blank has a center fold line defining opposite sectors folded upon themselves, with their top edges secured together to form a hood. A side flap is integral with one of the sectors, extends along one longitudinal edge thereof, and is folded back upon the one sector. The corresponding side edge portion of the other sector is loosely positioned beneath the flap when the blank is formed into the hood. Each of the sectors have a bottom edge portion that is partially separated by a cut formed in the center fold line adjacent the bottom edge of the sectors. A slit extends in opposite directions from the junction of the first fold line and the cut towards the flap provided by one of the sectors and the side edge portion of the outer sector so as to provide elongated tying strips. The strips extend from the corresponding lower corner portions of each of the sectors and about the bottom edges of the sectors for constricting the head covering about the neck of the wearer.

A SECOND EXAMPLE, U.S. Patent Office Document No. 3,197,787, Published/Issued on Aug. 3, 1965, to Tognan, et al. teaches a protective head covering including an elongated band of predetermined length and width to extend across the back and along the sides of a coiffure set with hair curlers and leave the top portion of the head exposed for ventilation. The band has opposed layers of soft and pliable material secured together along their marginal edge portions to provide a closed compartment having pliable walls. A granular filling material is in the compartment in such quantity and particle size to be shiftable in the compartment and form therewith a pliable cushion adapted to be molded in place on the coiffure by manipulation of the outer wall of the compartment to provide cushioning areas of relatively thick cross section corresponding to and registering with the areas of the coiffure between hair curlers and areas of relatively thin cross section corresponding to and registering with the areas of the coiffure set with hair curlers, whereby to protect the wearer's head when reclining against the pressure of the hair curlers and prevent relative movement of the hair curlers. Apparatus secures the band in place on the wearer's head and maintaining the filling material in proper relative position in the compartment.

A THIRD EXAMPLE, U.S. Patent Office Document No. 4,683,596, Issued on Aug. 4, 1987, to Cole teaches a curl keeping hair cap made of a substantially circular sheet of nonabsorbent air permeable material for permitting air circulation, with a casing secured along the circular edge of the sheet, and with a drawstring having an elastic portion extending through the casing to permit adjustment of the hair cap to fit the contour of the face and neck of the wearer by gathering along the casing. The drawstring has tie ends that are tied to each other to maintain the elastic portion of the drawstring in a stretched condition. The hair cap is made of a single piece of nylon. A method of maintaining a hair permanent includes applying permanent curl solution to hair, rinsing the solution from the hair, and enclosing the hair in a substantially circular curl keeping hair cap of nonabsorbent air permeable material, with a drawstring having an elastic portion to gather the cap and fit the contour of the face and neck.

A FOURTH EXAMPLE, U.S. Patent Office Document No. 5,265,278, Issued on Nov. 30, 1993, to Watanabe teaches a hair cap having a ceramic paper cap of a ceramic paper material sandwiched between an inner cap and an outer cap that are both formed of an impermeable synthetic resin material, and when used in permanent wave hairdressing or bathing, encourages the waving or curling of the hair and the metabolization of the head skin with the heating action of far infrared rays emitted from the ceramic paper cap.

A FIFTH EXAMPLE, U.S. Patent Office Document No. 5,477,561, Issued on Dec. 26, 1995, to Adkins teaches a head garment including an exterior portion, a lining, and a stretch band. The garment is formed by folding a rectangular piece of material in half and sewing top and side edges of the folded material to leave an open bottom edge to create a lining. Next, except for a small portion that is left unattached, an exterior circular piece of material is then sewn to the open bottom edge of the rectangular material. The folded rectangular and circular pieces of material are then pulled through the small opening left at the unattached portion, and finally an elastic stretch band is sewn to the two pieces of material to form the finished garment.

A SIXTH EXAMPLE, U.S. Patent Office Document No. 6,216,278, Issued on Apr. 17, 2001, to Nguyen, et al. teaches a hair covering for protecting the hair of a wearer from damage due to exposure to the ultra violet light of a tanning bed. The hair covering includes an outer portion, a middle portion, and an inner portion. The middle portion protects the hair of a wearer from discoloration and other damage because of exposure to the ultra violet light of a tanning bed. Furthermore, the middle portion acts as a barrier to the heat build up that can occur within the hair covering because of the heat generated by ultra violet light in a tanning bed. The outer portion and the inner portion act as additional protection for blocking the heat generated by the ultra violet light of a tanning bed. The hair covering also has a stretchable band for providing a comfortable and snug fit around the head of a wearer.

A SEVENTH EXAMPLE, U.S. Patent Office Document No. 7,458,383, Issued on Dec. 2, 2008, to Song teaches a weft for hair extension and a method of extending the weft for hair extension to real hair that provides a plurality of space portions through which the real hair is passed between a pair of wig hair bundles that are bound to form the weft for hair extension and fixedly extends the real hair that is passed through the space portions to the weft for hair extension by use of a plurality of pressure rings.

AN EIGHTH EXAMPLE, U.S. Patent Office Document No. Des. 627,954, Issued on Nov. 30, 2010, to Williams teaches the ornamental design for a protective hair cap.

A NINTH EXAMPLE, U.S. Patent Office Document No. 2004/0168696, Published on Sep. 2, 2004, to Cox teaches a wig including a foundation made from generally circular blank of stretchable netting formed into a bowl shape as worn on a wearer's head. The bowl shape is formed by radially folding over the blank upon itself at a plurality of pairs of fold lines to form a plurality of radially-spaced triangular pleats. An elastic band is looped and attached to an outer periphery of the blank at a stretchable seam to maintain the pleats and the bowl shape. A plurality of hair wefts are attached to a convex outer surface of the foundation in a layered and spaced relationship at respective seams. Attachment areas of the hair wefts to the foundation are hidden by overlapping adjacent hair wefts. The hair wefts are arranged to simulate natural hair growth patterns, with hair wefts disposed transversely of the foundation pointing forwardly, downwardly, upwardly, or a combination thereof. Hair wefts at a crown of the foundation are centered about the crown pointing radially outwardly from the crown.

A TENTH EXAMPLE, U.S. Patent Office Document No. 2008/0047572, Published on Feb. 28, 2008, to Park teaches a wig arrangement provided with a primary wig and a hair piece extension. The primary wig has a first foundation, while the extension has a second foundation. The hair piece extension forms a second wig that is removably coupled to the primary wig. The primary wig is structured and arranged to be secured to a human head. The wig arrangement is worn either with the primary wig or a combination of the primary wig and the hair extension so as to change the look and styling of the wearer's head. Fasteners, such as snap fits, are used to removably secure the primary wig and the hair piece extension.

AN ELEVENTH EXAMPLE, U.S. Patent Office Document No. 2011/0132942, Published on Jun. 9, 2011, to Choi teaches a form that holds a hair extension and maintains the order and curl of the strands of hair. The form provides optimum display of the wig or hair extension evaluation by the prospective user. In addition, after purchase, the form provides a way for convenient space-saving storage of the hair extension, which maintains the appearance of the hair extension.

It is apparent now that numerous innovations for head/hair coverings have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a combination wig and carrying pouch that avoids the disadvantages of the prior art.

ANOTHER OBJECT of the present invention is to provide a combination wig and carrying pouch that is simple and inexpensive to manufacture.

STILL ANOTHER OBJECT of the present invention is to provide a combination wig and carrying pouch that is simple to use.

BRIEFLY STATED, STILL YET ANOTHER OBJECT of the present invention is to provide a wig for a wearer. The wig includes a cap and primary hair. The cap is worn by the wearer. The primary hair is affixed to the cap, and when the wig is worn by the wearer, the wearer has a pre-styled hairdo.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIGS. 11A-11C is a flow chart of the method for self-storing the wig of the embodiments of the present invention.

A MARSHALING OF REFERENCE NUMERALS UTILIZED IN THE DRAWING

Figure 1:
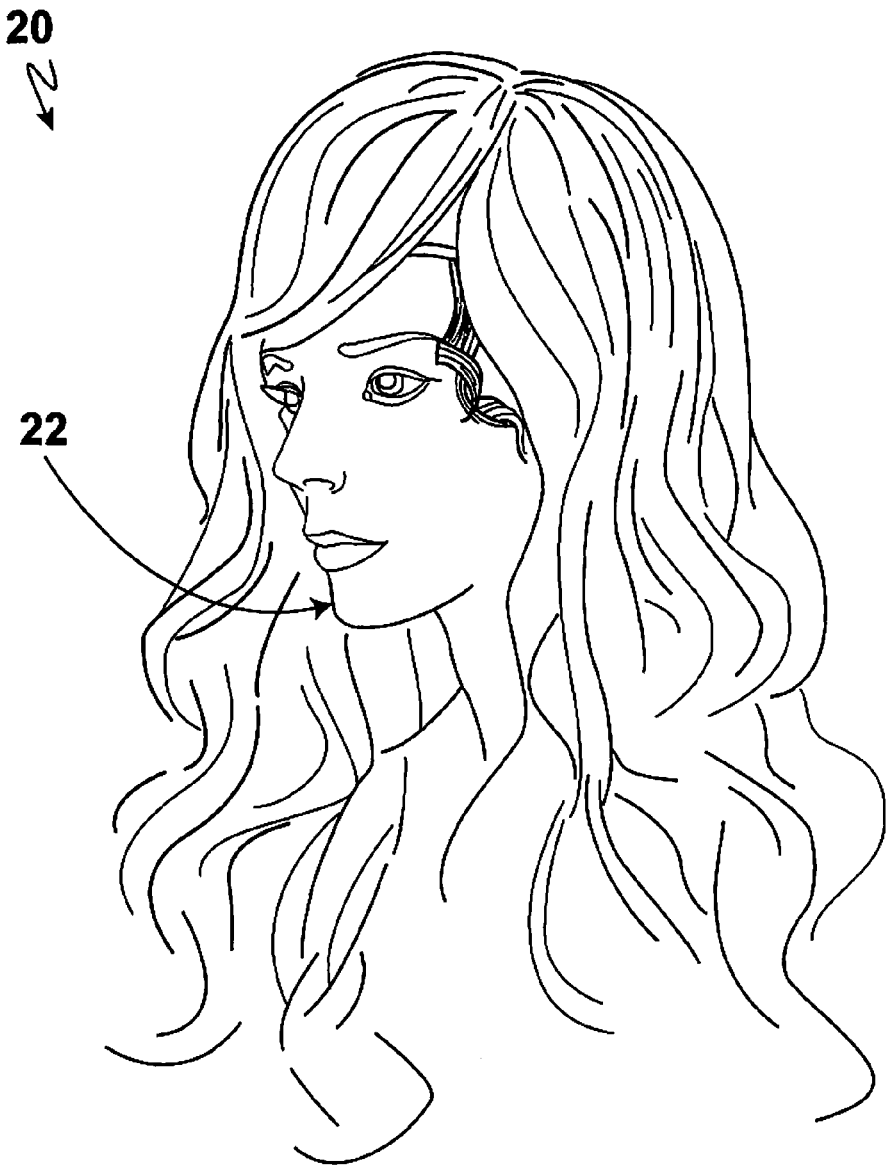
FIG. 1 is a diagrammatic perspective view illustrating a wig of the present invention being worn on a person's head.

20 wig of embodiments of present invention for wearer 22
22 wearer
24 cap for being worn by wearer 22
26 primary hair
28 open base of cap 24
30 circular edge defining open base 28 of cap 24
32 interior surface of cap 24
34 exterior surface of cap 24
36 crown of cap 24
38 three hair clip loops for receiving hair clips 40 for replaceable attaching wig 20 to wearer 22
40 hair clips for replaceable attaching wig 20 to wearer 22
42 drawstring assembly

44 drawstring band pocket of drawstring assembly 42
46 drawstring band of drawstring assembly 42
48 loop of drawstring band of drawstring assembly 42
50 drawstring closure of drawstring assembly 42
52 secondary hair of drawstring assembly 42 for functioning as either front bangs, French roll, ponytail, or any other versatile style

DETAILED DESCRIPTION OF THE PREFERRED EMBODIMENT

Figure 4:
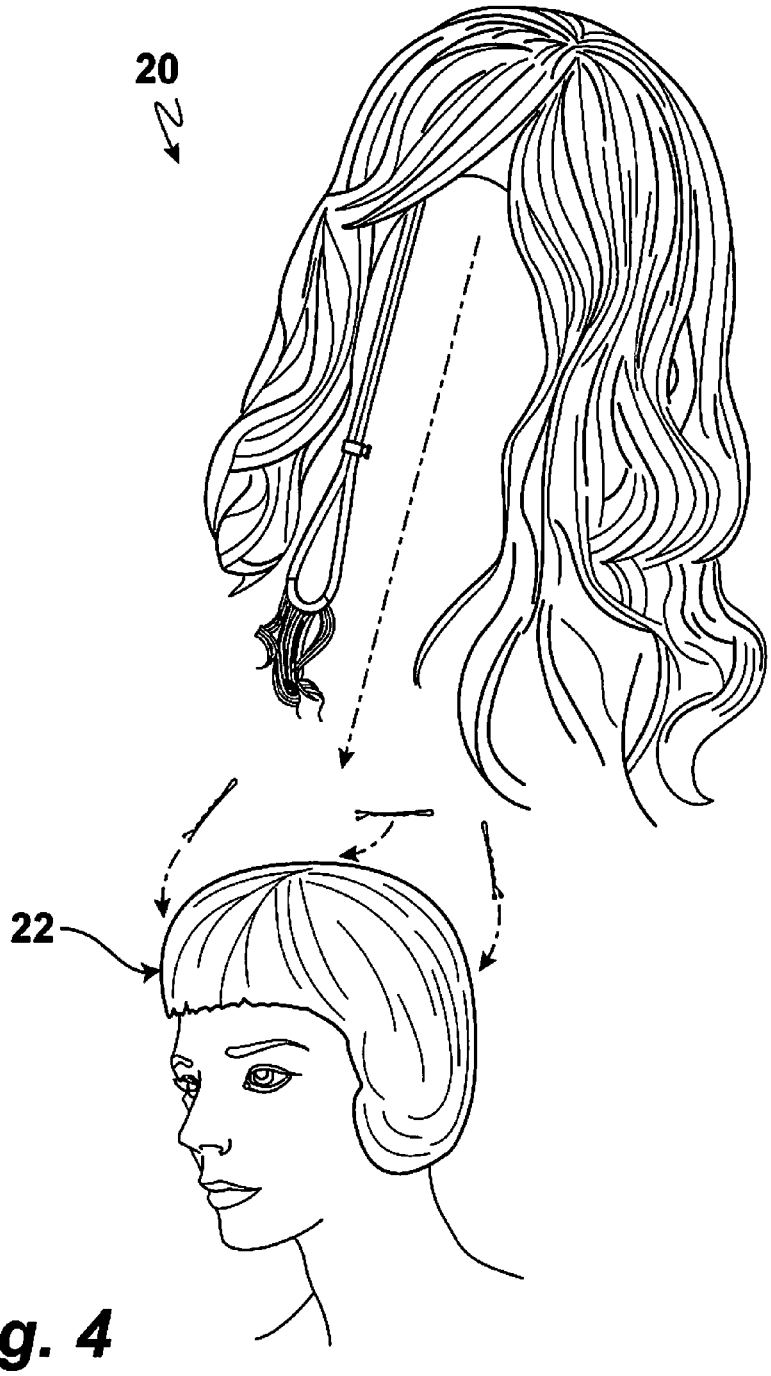
FIG. 4 show the fully assembled wig of the present invention in the process of being donned on a wearer's head over the wearer's full head of hair.

Referring now to the figures, in which like numerals indicate like parts, and particularly to FIGS. 1 and 4, which are, respectively, a diagrammatic perspective view illustrating a wig of the present invention being worn on a person's head, and the fully assembled wig of the present invention in the process of being donned on a wearer's head over the wearer's full head of hair, the wig of the embodiments of the present invention is shown generally at 20 for a wearer 22.

Figure 2:
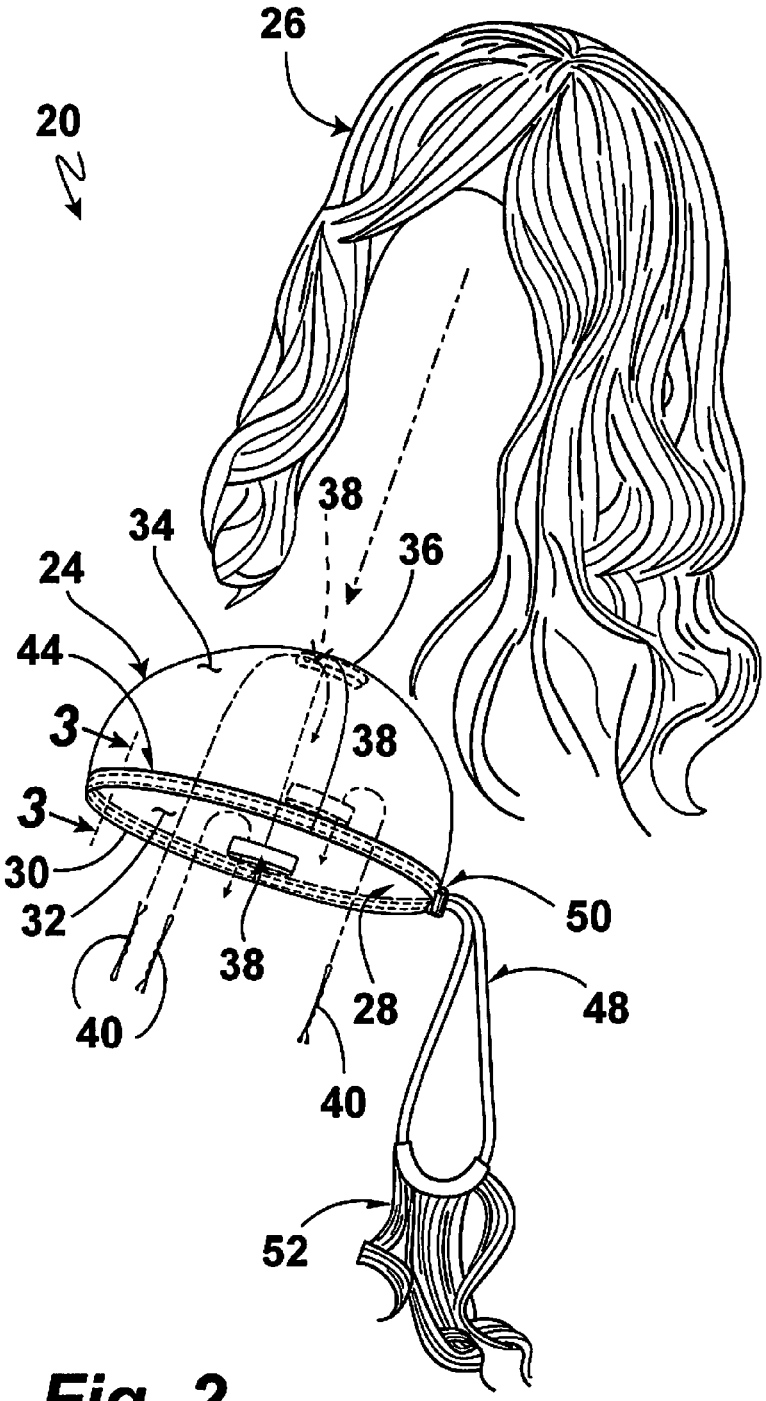
FIG. 2 is a diagrammatic exploded perspective view showing some of the components of the present invention separated from each other.
Figure 3:
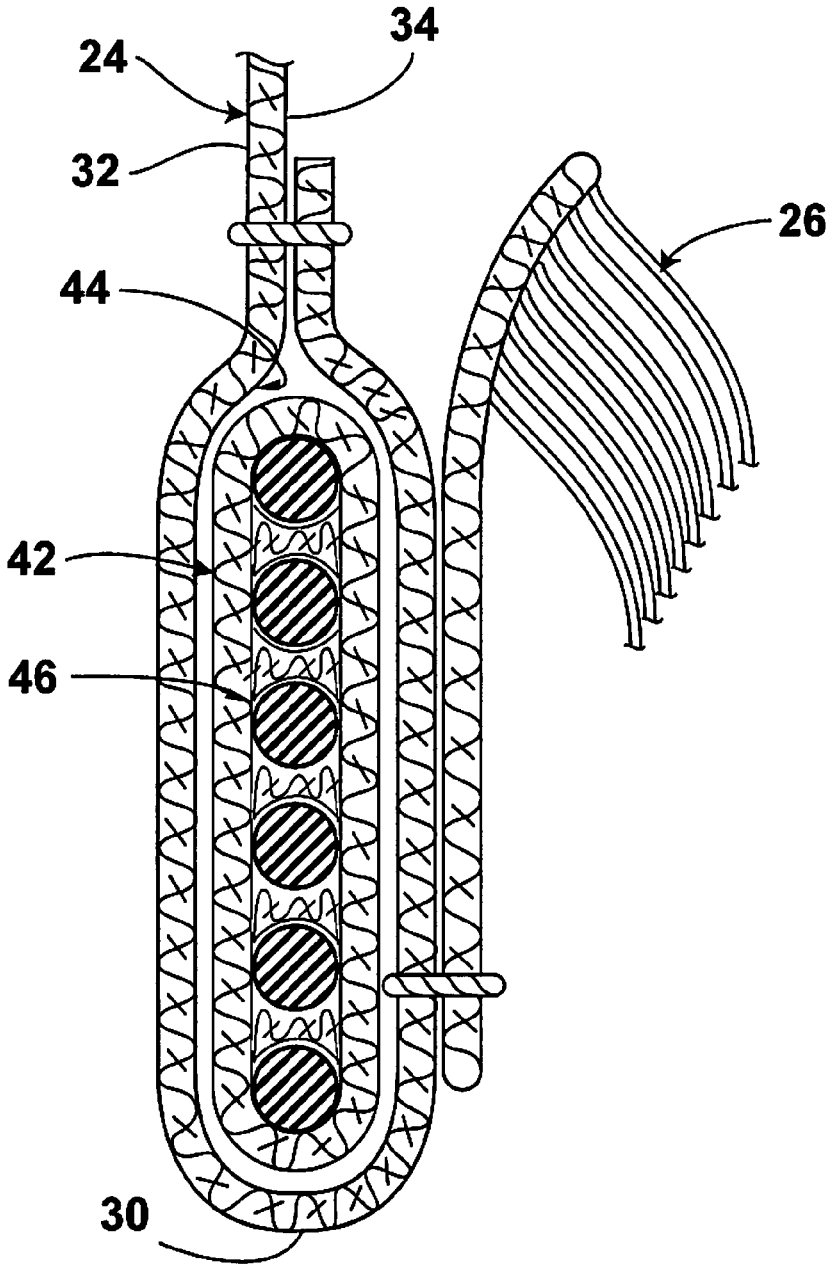
FIG. 3 is a greatly enlarged cross sectional view taken on line 3-3 in FIG. 2 showing the construction and securement together of various components of a scull cap portion of the present invention in greater detail.

The overall configuration of the wig 20 can best be seen in FIGS. 2 and 3, which are, respectively, a diagrammatic exploded perspective view showing some of the components of the present invention separated from each other, and a greatly enlarged cross sectional view taken on line 3-3 in FIG. 2 showing the construction and securement together of various components of a scull cap portion of the present invention in greater detail, and as such, will be discussed with reference thereto.

The wig 20 comprises a cap 24 and primary hair 26. The cap 24 is for being worn by the wearer 22. The primary hair 26 is affixed to the cap 24, and when the wig 20 is worn by the wearer 22, the wearer 22 has a pre-styled hairdo.

The cap 24 is hollow and hemispherically shaped, and as such, has an open base 28 defined by a circular edge 30, an interior surface 32, an exterior surface 34, and a crown 36.

The cap 24 is made from either silk or satin for not irritating when worn by the wearer 22.

The wig 20 further comprises three hair clip loops 38. The three hair clip loops 38 are for receiving hair clips 40 for replaceable attaching the wig 20 to the wearer 22.

The three hair clip loops 38 are disposed on the interior surface 32 of the cap 24.

A first hair clip loop 38 is positioned at the crown 36 of the cap 24.

A second hair clip loop 38 is positioned at the circular edge 30 of the cap 24.

A third hair clip loop 38 is positioned at the circular edge 30 of the cap 24, opposite to the second hair clip loop 38.

The wig 20 further comprises a drawstring assembly 42.

The drawstring assembly 42 comprises a drawstring band pocket 44.

The drawstring band pocket 44 of the drawstring assembly 42 is disposed around the circular edge 30 of the cap 24, and can be formed, by bending the circular edge 30 of the cap 24 onto itself and attaching.

The drawstring assembly 42 further comprises a drawstring band 46.

The drawstring band 46 of the drawstring assembly 42 is elastic, and extends through, and out of, the drawstring band pocket 44 of the drawstring assembly 42 to form a loop 48.

The loop 48 of the drawstring band 46 of the drawstring assembly 42 is disposed externally to, and depends from, the cap 24.

The drawstring assembly 42 further comprises a drawstring closure 50.

The drawstring closure 50 of the drawstring assembly 42 is self-locking and spring-loaded.

The drawstring closure 50 of the drawstring assembly 42 rides along the loop 48 of the drawstring band 46 of the drawstring assembly 42 for tightening around or loosening the drawstring band 46 of the drawstring assembly 42 relative to the wearer 22 so as to allow the cap 24 to be snug on the wearer 22 or be removed from the wearer 24, respectively.

The drawstring assembly 42 further comprises secondary hair 52.

The secondary hair 52 of the drawstring assembly 42 is movably attached along the loop 48 of the drawstring band 46 of the drawstring assembly 42, and is for functioning as either front bangs, a French roll, a ponytail, or any other versatile style.

The method for self-storing the wig 20 can best be seen in FIGS. 5, 6, 7, 8, 9, 10, and 11A-11C, which are, respectively, diagrammatic perspective view showing the wig of the present invention per se, right side up in the manner it would be if it were on a wearer's upright head, a diagrammatic perspective view showing the wig of the present invention per se, inverted so that it is up side down with the hair hanging down from a convex surface of the scull cap, with an arrow pointing in the direction in which the scull cap may be pulled there from so that the surface which the hair is presently attached is transformed from a convex surface to a concave surface as shown in phantom lines, a diagrammatic perspective view showing the wig of the present invention still inverted so that it is up side down with the hair hanging down, but with the scull cap pulled out vertically upwards, and the hair depending out of what is now been transformed into a concave surface of the scull cap, a diagrammatic perspective view showing the wig of the present invention substantially similar to FIG. 7 but again inverted 180 degrees, as indicated was about to happen by the semi circular arrow in FIG. 7, diagrammatically illustrates the hair now being stuffed inside transformed concave surface of the scull cap, diagrammatically illustrates the wig of the present invention after the draw strings have been pulled tightly closed so as to gather a peripheral edge of the scull cap together so as to form a pouch with the hair component of the wig captured inside thereof, and what was the surface of the scull cap which was worn in intimate contact with the wearer's head now being transformed into the exterior surface of the carrying pouch, and a flow chart of the method for self-storing the wig of the embodiments of the present invention, and as such, will be discussed with reference thereto.

Figure 5:
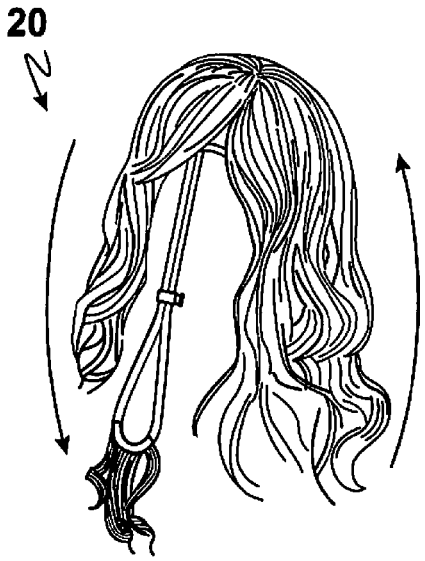
FIG. 5 is diagrammatic perspective view showing the wig of the present invention per se, right side up in the manner it would be if it were on a wearer's upright head.
Figure 6:
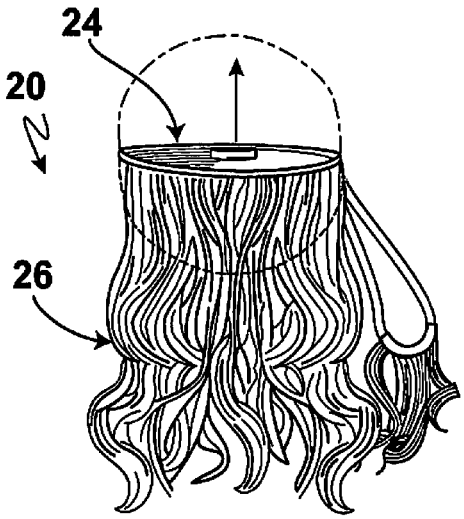
FIG. 6 is a diagrammatic perspective view showing the wig of the present invention per se, inverted so that it is up side down with the hair hanging down from a convex surface of the scull cap, with an arrow pointing in the direction in which the scull cap may be pulled there from so that the surface which the hair is presently attached is transformed from a convex surface to a concave surface as shown in phantom lines.
Figure 7:
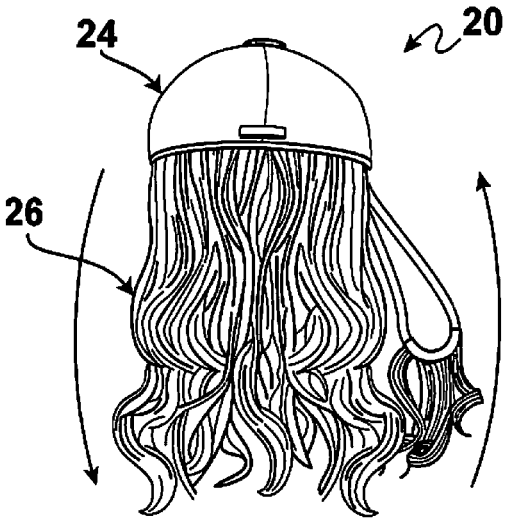
FIG. 7 is a diagrammatic perspective view showing the wig of the present invention still inverted so that it is up side down with the hair hanging down, but with the scull cap pulled out vertically upwards, and the hair depending out of what is now been transformed into a concave surface of the scull cap.
Figure 8:
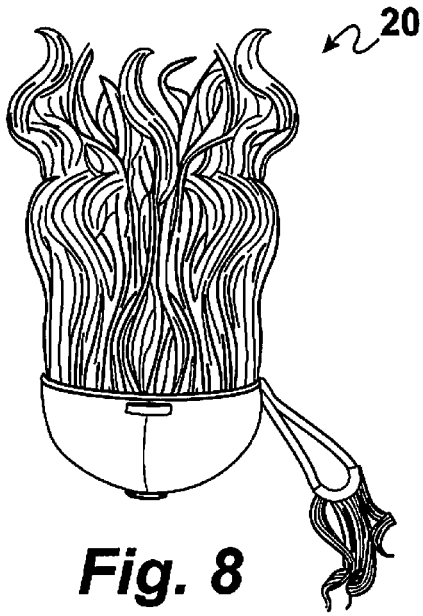
FIG. 8 is a diagrammatic perspective view showing the wig of the present invention substantially similar to FIG. 7 but again inverted 180 degrees, as indicated was about to happen by the semi circular arrow in FIG. 7.
Figure 9:
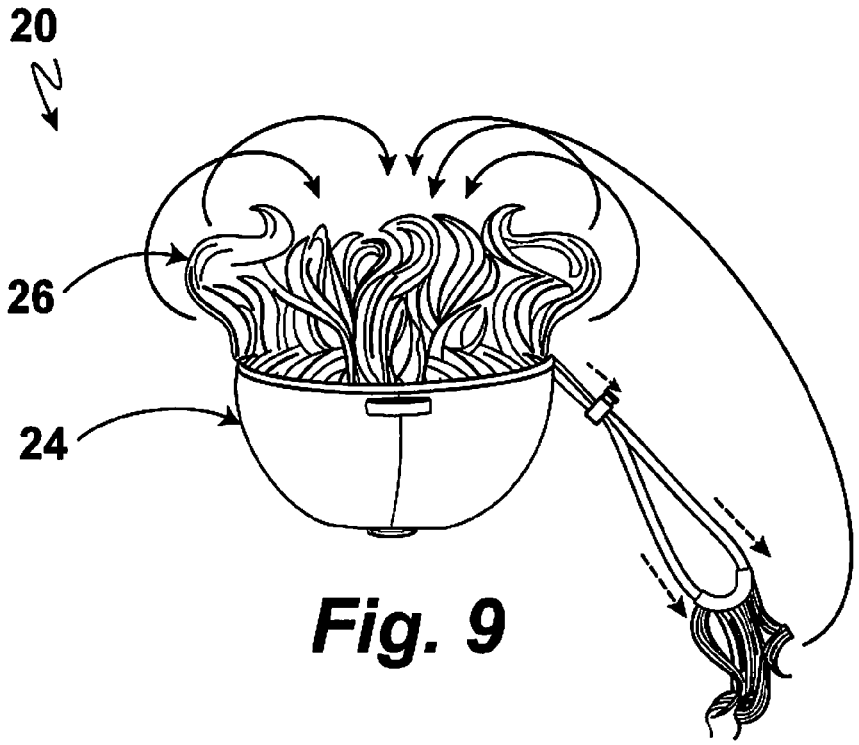
FIG. 9 diagrammatically illustrates the hair now being stuffed inside transformed concave surface of the scull cap.
Figure 10:
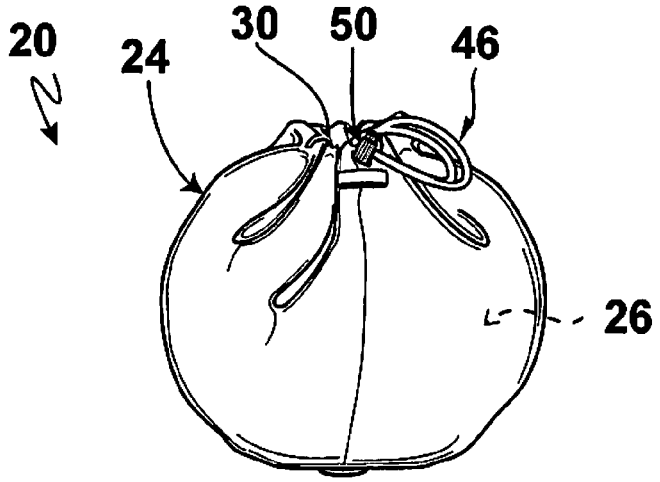
FIG. 10 diagrammatically illustrates the wig of the present invention after the draw strings have been pulled tightly closed so as to gather a peripheral edge of the scull cap together so as to form a pouch with the hair component of the wig captured inside thereof, and what was the surface of the scull cap which was worn in intimate contact with the wearer's head now being transformed into the exterior surface of the carrying pouch.

The method for self-storing the wig 20 comprises the steps of:

STEP 1: As shown in FIGS. 5 and 11A, position the wig 20 right-side-up;

STEP 2: As shown in FIGS. 6 and 11A, invert the wig 20 to be up-side-down, with the primary hair 26 hanging down from the cap 24 that is now downwardly curving;

STEP 3: As shown in FIGS. 7 and 11B, invert the cap 24 to be upwardly curving, with the primary hair 26 depending therefrom;

STEP 4: As shown in FIGS. 8 and 11B, turn the wig 20 up-side-down;

STEP 5: As shown in FIGS. 9 and 11B, stuff the primary hair 26 into the cap 24; and STEP 6: As shown in FIGS. 10 and 11C, pull the drawstring band 46 of the drawstring assembly 42 tight by tightening the drawstring closure 50 of the drawstring assembly 42 so as to tightly close the cap 24, and in so doing, gather the circular edge 30 of the cap 24 together so as to form a pouch with the primary hair 26 captured thereinside.

It will be understood that each of the elements described above, or two or more together, may also find a useful application in other types of constructions differing from the types described above.

While the invention has been illustrated and described as embodiments of a combination wig and carrying pouch, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A wig for a wearer, comprising:

a) a cap; and b) primary hair;

wherein said cap is for being worn by the wearer; and wherein said primary hair is a affixed to said cap, and when said wig is worn by the wearer, the wearer has a pre-styled hairdo;

wherein said cap has:

c) an open base;

d) an interior surface;

e) an exterior surface; and f) a crown;

wherein said open base of said cap is defined by a circular edge, further comprising a drawstring assembly;

wherein said drawstring assembly comprises a drawstring band pocket;

wherein said drawstring assembly comprises a drawstring band;

wherein said drawstring band of said drawstring assembly extends through, and out of, said drawstring band pocket of said drawstring assembly to form a loop;

wherein said drawstring assembly comprises secondary hair, wherein said secondary hair of said drawstring assembly is movably attached along said loop of said drawstring band of said drawstring assembly; and wherein said secondary hair of said drawstring assembly is for functioning as either front bangs, a French roll, or a ponytail.

2. The wig of claim 1, wherein said cap is hollow.

3. The wig of claim 1, wherein said cap is hemispherically shaped.

4. The wig of claim 1, wherein said cap is made from silk for not irritating when worn by the wearer.

5. The wig of claim 1, wherein said cap is made from satin for not irritating when worn by the wearer.

6. The wig of claim 1, further comprising three hair clip loops; and wherein said three hair clip loops are for receiving hair clips for replaceably attaching said wig to the wearer.

7. The wig of claim 6, wherein said three hair clip loops are disposed on said interior surface of said cap.

8. The wig of claim 7, wherein a first hair clip loop is positioned at said crown of said cap.

9. The wig of claim 8, wherein a second hair clip loop is positioned at said circular edge of said cap.

10. The wig of claim 9, wherein a third hair clip loop is positioned at said circular edge of said cap.

11. The wig of claim 10, wherein said third hair clip loop is disposed opposite to said second hair clip loop.

12. The wig of claim 1, wherein said drawstring band pocket of said drawstring assembly is disposed around said circular edge of said cap.

13. The wig of claim 1, wherein said drawstring band pocket of said drawstring assembly is formed by bending said circular edge of said cap onto itself and attaching.

14. The wig of claim 1, wherein said drawstring band of said drawstring assembly is elastic.

15. The wig of claim 1, wherein said loop of said drawstring band of said drawstring assembly is disposed externally to said cap.

16. The wig of claim 1, wherein said loop of said drawstring band of said drawstring assembly depends from said cap.

17. The wig of claim 1, wherein said drawstring assembly comprises a drawstring closure.

18. The wig of claim 17, wherein said drawstring closure of said drawstring assembly is self-locking.

19. The wig of claim 17, wherein said drawstring closure of said drawstring assembly is spring-loaded.

20. The wig of claim 17, wherein said drawstring closure of said drawstring assembly rides along said loop of said drawstring band of said drawstring assembly for tightening around or loosening said drawstring band of said drawstring assembly relative to the wearer so as to allow said cap to be snug on the wearer or be removed from the wearer, respectively.

21. A method for self-storing a wig having a cap with a circular edge, primary hair, and a drawstring assembly having a drawstring band and a drawstring closure, comprising the steps of:

a) positioning the wig right-side-up;

b) inverting the wig to be up-side-down, with the primary hair hanging down from the cap that is now downwardly curving;

c) inverting the cap to be upwardly curving, with the primary hair depending therefrom;

d) turning the wig up-side-down;

e) stuffing the primary hair into the cap; and f) pulling said drawstring band of the drawstring assembly tight by tightening the drawstring closure of the drawstring assembly so as to tightly close the cap, and in so doing, gather said circular edge of the cap together so as to form a pouch with the primary hair captured therein-side.

* * * * *